US007740751B2

(12) United States Patent
Peters

(10) Patent No.: US 7,740,751 B2
(45) Date of Patent: Jun. 22, 2010

(54) PROCESS FOR HEATING A STREAM FOR A HYDROCARBON CONVERSION PROCESS

(75) Inventor: Kenneth D. Peters, Elmhurst, IL (US)

(73) Assignee: UOP LLC, Des Plaines, IL (US)

( * ) Notice: Subject to any disclaimer, the term of this patent is extended or adjusted under 35 U.S.C. 154(b) by 605 days.

(21) Appl. No.: 11/558,053

(22) Filed: Nov. 9, 2006

(65) Prior Publication Data

US 2008/0110800 A1 May 15, 2008

(51) Int. Cl.
*C10G 35/02* (2006.01)

(52) U.S. Cl. ..... 208/63; 208/56; 208/133

(58) Field of Classification Search ..... 208/133, 208/56, 63

See application file for complete search history.

(56) References Cited

U.S. PATENT DOCUMENTS

| | | | |
|---|---|---|---|
| 1,940,355 | A | 12/1933 | Knapp |
| 2,270,863 | A | 1/1942 | Barnes |
| 2,348,512 | A | 5/1944 | Barnes |
| 2,625,917 | A | 1/1953 | Barnes |
| 2,809,922 | A | 10/1957 | Berg et al. |
| 2,946,736 | A | 7/1960 | Muffat et al. |
| 3,011,965 | A | 12/1961 | Decker |
| 3,018,244 | A | 1/1962 | Stanford et al. |
| 3,392,107 | A | 7/1968 | Pfefferle |
| 3,760,168 | A | 9/1973 | Boyd |
| 3,761,392 | A | 9/1973 | Pollock |
| 3,776,837 | A | 12/1973 | Dautzenberg et al. |
| 3,785,955 | A | 1/1974 | Davis |
| 3,869,377 | A | 3/1975 | Eisenlohr et al. |
| 3,925,503 | A | 12/1975 | Parthasarathy |
| 3,998,188 | A | 12/1976 | Priest et al. |
| 4,072,601 | A | 2/1978 | Patouillet |
| 4,104,149 | A | 8/1978 | Veinerman et al. |
| 4,162,212 | A | 7/1979 | Miller |
| 4,181,599 | A | 1/1980 | Miller et al. |
| 4,315,893 | A | 2/1982 | McCallister |
| 4,324,649 | A | 4/1982 | Parizot et al. |
| 4,325,806 | A | 4/1982 | Peters |

(Continued)

OTHER PUBLICATIONS

Walas, Stanley M., Chemical Process Equipment—Selection and Design, 1990 (no month), Butterworth-Heinemann, pp. 212-213.*

(Continued)

*Primary Examiner*—Walter D Griffin
*Assistant Examiner*—Renee Robinson
(74) *Attorney, Agent, or Firm*—Kurt D Van Tassel

(57) ABSTRACT

One exemplary embodiment of the present invention can be a hydrocarbon conversion process. The process may include passing a hydrocarbon stream through at least one heater including at least one burner, a radiant section, and a convection section. Generally, the stream passes through the radiant section and then through the convection section before exiting the heater. Desirably, the hydrocarbon stream includes, in percent or parts by weight based on the total weight of hydrocarbons in the stream:

$C_4$ or less: less than about 0.5%, sulfur or sulfur containing compounds: less than about 1 ppm, and nitrogen or nitrogen containing compounds: less than about 1 ppm.

Preferably, the sulfur or sulfur containing compounds and the nitrogen or nitrogen containing compounds are measured as, respectively, elemental sulfur or nitrogen.

21 Claims, 2 Drawing Sheets

U.S. PATENT DOCUMENTS

| | | | | |
|---|---|---|---|---|
| 4,325,807 | A | 4/1982 | Peters | |
| 4,343,958 | A | 8/1982 | Gewartowski | |
| 4,409,095 | A | 10/1983 | Peters | |
| 4,431,522 | A | 2/1984 | James, Jr. | |
| 4,441,988 | A | 4/1984 | Irvine | |
| 4,454,839 | A | 6/1984 | Gater et al. | |
| 4,457,832 | A | 7/1984 | Robinson | |
| 4,494,485 | A | 1/1985 | Kendall et al. | |
| 4,665,272 | A | 5/1987 | Bakas et al. | |
| 4,665,273 | A | 5/1987 | Johnson et al. | |
| 4,911,822 | A | 3/1990 | Franck et al. | |
| 4,986,222 | A | 1/1991 | Pickell et al. | |
| 4,996,387 | A | 2/1991 | Gerhold et al. | |
| 5,091,075 | A | 2/1992 | O'Neill et al. | |
| 5,110,478 | A | 5/1992 | Haag et al. | |
| 5,186,909 | A | 2/1993 | Dang Vu et al. | |
| 5,256,277 | A | 10/1993 | Del Rossi et al. | |
| 5,389,342 | A | 2/1995 | Savage et al. | |
| 5,618,322 | A | 4/1997 | Mizuno et al. | |
| 5,658,453 | A | 8/1997 | Russ et al. | |
| 5,792,338 | A | 8/1998 | Gosling et al. | |
| 5,879,537 | A | 3/1999 | Peters | |
| 6,106,696 | A | 8/2000 | Fecteau et al. | |
| 6,280,864 | B1 | 8/2001 | Towler et al. | 429/17 |
| 6,284,128 | B1 | 9/2001 | Glover et al. | |
| 6,441,263 | B1 | 8/2002 | O'Rear et al. | |
| 6,458,266 | B1 * | 10/2002 | Lin et al. | 208/139 |
| 6,732,796 | B2 | 5/2004 | Vinegar et al. | |
| 6,835,360 | B2 | 12/2004 | Warren | |
| 6,875,338 | B2 | 4/2005 | Lenglet et al. | |
| 6,878,855 | B2 | 4/2005 | Deckman et al. | |
| 6,880,635 | B2 | 4/2005 | Vinegar et al. | |
| 6,910,878 | B2 | 6/2005 | Leger | |
| 2002/0035306 | A1 | 3/2002 | Gore et al. | 585/833 |
| 2003/0070963 | A1 | 4/2003 | Zimmermann et al. | |
| 2003/0113244 | A1 | 6/2003 | Dupont et al. | |
| 2004/0065014 | A1 | 4/2004 | Christensen et al. | |
| 2004/0175663 | A1 * | 9/2004 | Melton et al. | 431/9 |
| 2005/0011810 | A1 * | 1/2005 | Salmon | 208/63 |

OTHER PUBLICATIONS

York et al., *UOP Catalytic Condensation Process For Transportation Fuels*, Handbook of Petroleum Refining Processes, 1997, pp. 1.21-1.29.

Nelson, W.L., "Chapter 18: Tubestill Heaters", Petroleum Refinery Engineering, pp. 585-599; Fourth Edition, McGraw-Hill, 1958.

* cited by examiner

PROCESS FOR HEATING A STREAM FOR A HYDROCARBON CONVERSION PROCESS

FIELD OF THE INVENTION

The field of this invention is heating a stream entering a reaction zone.

BACKGROUND OF THE INVENTION

Hydrocarbon conversion processes often employ multiple reaction zones through which hydrocarbons pass in a series flow. Each reaction zone in the series often has a unique set of design requirements. A minimum design requirement of each reaction zone in the series is the hydraulic capacity to pass the desired throughput of hydrocarbons that pass through the series. An additional design requirement of each reaction zone is sufficient heating to perform a specified degree of hydrocarbon conversion.

One well-known hydrocarbon conversion process can be catalytic reforming. Generally, catalytic reforming is a well-established hydrocarbon conversion process employed in the petroleum refining industry for improving the octane quality of hydrocarbon feedstocks, the primary product of reforming being a motor gasoline blending component or a source of aromatics for petrochemicals. Reforming may be defined as the total effect produced by dehydrogenation of cyclohexanes and dehydroisomerization of alkylcyclopentanes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins. A reforming feedstock can be a hydrocracker, straight run, FCC, or coker naphtha, and can contain many other components such as a condensate or a thermal cracked naphtha. Typically, such a hydrocarbon feedstock contains high levels of impurities unsuited for a conversion product, such as reformate. These impurities can include sulfur and nitrogen, and such a feed can have levels of sulfur ranging from about 10-about 17,500 wt.-ppm and nitrogen ranging from about 0.2-about 450 wt.-ppm.

Heaters or furnaces are often used in hydrocarbon conversion processes, such as reforming, to heat the process fluid before it is reacted. Generally, fired heaters or furnaces include an all radiant fired heating zone to heat the fluid with a convection section being used for another service, such as producing steam. Other fired heaters can have an initial convection section followed in a series by a radiant section. Having the convection section first allows for the process fluid to recover more heat from the flue gas because, generally, the convection section is at a lower temperature as compared to the radiant section of the heater. Additionally, both of these heater designs are applicable to charge heaters and interheaters. Each section includes tubes to contain the process fluid flowing through the heater.

However, these conventional designs suffer disadvantages. Sometimes a conversion unit is limited by the heater if increasing the firing of the heater raises the temperature of the radiant and/or convection tubes to their maximum tube wall limit. If the throughput of a heater is limited by a maximum tube wall temperature, then the production rate of the entire conversion unit can be constrained.

Moreover, generally there are three problems associated with operating a heater at or near the maximum temperature of the tube walls. First, high tube wall temperatures increase the tendency of flue gas to oxidize on the sides of the tubes, leading to the formation of scale that decreases the radiant efficiency of the heater. Second, high tube wall temperatures, particularly with respect to the first two reactors in a conversion process such as reforming, can cause cracking of the feed reducing yield. Third, an additional complication is that reforming heaters are also susceptible to having metal-catalyzed coking in the fired heater tubes at higher temperatures. Metal catalyzed coking can cause the shutdown of reforming units for maintenance work to remove the coke deposits in the reactors resulting from the onset of metal catalyzed coke formation in the fired heater tubes. As a result, lower tube wall temperatures are very desirable.

There are several solutions to coking problems associated with high tube wall temperatures, but each has its drawbacks:

a) sulfur can be injected that inhibits coke formation, but this solution generally decreases reformer yields and may be unnecessary for some feeds that do not tend to coke;

b) the radiant tubes can be replaced with tubes of different alloys that can raise the maximum allowable heater tube wall temperature, but these alloys tend to be more expensive;

c) the heater can be enlarged with more tubes and/or burners to increase surface area, but enlarging a heater is usually expensive; and d) a heater can be added to the series of heaters to provide some of the required duty, so the size of the existing heater can be decreased. However, adding a heater is also usually expensive.

Additionally, sometimes conversion units are refurbished during shutdowns to increase the capacity of the units. High fired heater tube wall temperatures can limit the potential feed rate increase or reformate octane increase for conversion units, such as reforming units. Such tube wall temperature limitations can result in the installation of large expensive fired heater cells. Such fired heater cells can be about 20% to 25% of the estimated cost of a conversion unit, such as a reforming unit.

Therefore, there is a desire to increase the feed through a conversion unit and not exceed the maximum tube wall temperature without incurring at least some of the disadvantages discussed above.

Information Disclosure

U.S. Pat. No. 4,986,222 (Pickell) discloses a bottom fired fixed vertical heater including radiant and convection coils that heats a hydrocarbon feedstock, preferably naphtha, before the feedstock is desulfurized in a desulfurizing unit and then to a reforming unit. The convection coils communicate with the radiant coils to receive, convey and pass the hydrocarbon feedstock from the radiant coils to the desulfurizing unit.

U.S. Pat. No. 5,879,537 (Peters) discloses a multistage catalytic hydrocarbon conversion system where hydrocarbons flow serially through at least two reaction zones.

U.S. Pat. No. 6,106,696 (Fecteau et al.) discloses a reforming process that employs at least two moving bed reaction zones.

U.S. Pat. Nos. 4,986,222; 5,879,537; and 6,106,696 are hereby incorporated by reference in their entirety.

BRIEF SUMMARY OF THE INVENTION

One exemplary embodiment of the present invention can be a hydrocarbon conversion process. The process may include passing a hydrocarbon stream through at least one heater including at least one burner, a radiant section, and a convection section. Generally, the stream passes through the radiant section and then through the convection section before exiting the heater. Desirably, the hydrocarbon stream includes, in percent or parts by weight based on the total weight of hydrocarbons in the stream:

$C_4$ or less: less than about 0.5%, sulfur or sulfur containing compounds: less than about 1 ppm, and nitrogen or nitrogen containing compounds: less than about 1 ppm.

Preferably, the sulfur or sulfur containing compounds and the nitrogen or nitrogen containing compounds are measured as, respectively, elemental sulfur or nitrogen.

Another exemplary reforming process can include operating a reforming unit and passing a stream including hydrocarbons through the radiant section, next through the convection section, and then to an inlet of the reaction zone. Generally, the reforming unit includes at least one heater including at least one burner, a radiant section, and a convection section, and a reforming reactor including a reaction zone.

An exemplary refinery or petrochemical production facility can include a reforming unit, which in turn may include a heater including a burner, a radiant section, and a convection section, and a reforming reactor. The radiant section can include a first tube having an inlet and an outlet for receiving a hydrocarbon stream entering the heater, and a convection section can include a second tube having an inlet and an outlet for receiving the hydrocarbon stream exiting the first tube of the radiant section. The reforming reactor can have a reaction zone, which can receive the hydrocarbon stream from the outlet of the second tube.

In another exemplary embodiment, a hydrocarbon process may include passing a stream at a feed rate to at least one heater having at least one burner, a radiant section, and a convection section. The stream may include hydrocarbons and a concentration of sulfur less than 1 wt-ppm based on the weight of hydrocarbons in the stream, and the radiant section of the heater can operate at a maximum tube wall temperature. An enhancement to such an embodiment can include increasing the feed rate and decreasing the tube wall temperature by passing the stream through the radiant section and then through the convection section before exiting at least one heater.

The present invention can, with respect to conversion units such as reforming units, allow the economic design or expansion of an existing reforming unit by adding a convection section process coil after the radiant coil in one or more fired heater cells. In an existing heater unit, such a modification may be done with minimal changes to the existing heater components, thereby reducing both the capital costs of equipment and shutdown time. Thus, the present invention can be particularly well-suited for revamping an existing heater suffering from maximum tube wall temperature limitations, which is generally below about 640° C. (about 1,184° F.), preferably no more than about 635° C. (about 1,175° F.). The lower resultant fired heater tube wall temperature(s) may also reduce the potential for metal catalyzed coking in the fired heater tubes, which can increase the reliability of the subsequent reactor zones and avoid some of the disadvantages associated with other coking solutions as discussed above.

DEFINITIONS

Figure 1:
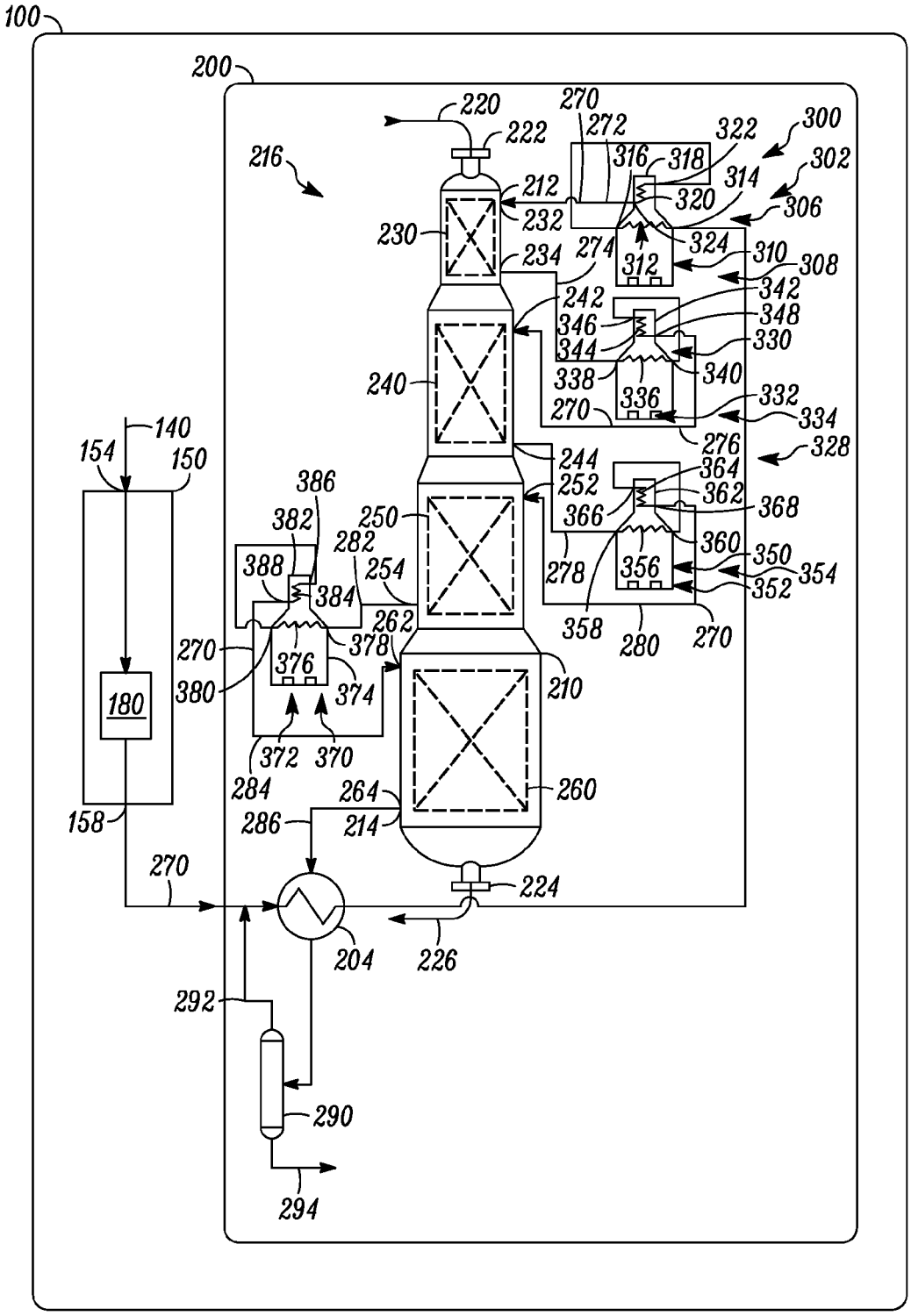
FIG. 1 is a schematic depiction of an exemplary refinery that can include a desulfurization unit and a reforming unit of the present invention.

As used herein, the term "hydrocarbon stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals. The hydrocarbon stream may be subject to reactions, e.g., reforming reactions, but still may be referred to as a hydrocarbon stream, as long as at least some hydrocarbons are present in the stream after the reaction. Thus, the hydrocarbon stream may include streams that are subjected to, e.g., a hydrocarbon stream effluent, or not subjected to, e.g., a naphtha feed, one or more reactions. As used herein, a hydrocarbon stream can also include a raw hydrocarbon feedstock, a hydrocarbon feedstock, a feed, a feed stream, a combined feed stream or an effluent. Moreover, the hydrocarbon molecules may be abbreviated $C_1$, $C_2$, $C_3$ . . . $C_n$ where "n" represents the number of carbon atoms in the hydrocarbon molecule.

As used herein, the term "radiant section" generally refers to a section of a heater receiving about 35-about 65% for substantially fouled tubes or about 45-about 65% for relatively clean tubes of the heat, primarily by radiant and convective heat transfer, released by, e.g., the fuel gas burned by the heater.

As used herein, the term "convection section" generally refers to a section of a heater receiving about 10-about 45% of the heat, primarily by convective and radiant heat transfer by, e.g., the flue gas, released by the fuel gas burned by the heater. Typically, about 7-about 15% of the heat is lost through the stack, so usually no more than about 93% of the heat released by the fuel is utilized in the radiant and convection sections.

As used herein, the term "heater" can include a furnace, a charge heater, or an interheater. A heater can include at least one burner and can include at least one radiant section, at least one convection section, or a combination of at least one radiant section and at least one convection section.

DETAILED DESCRIPTION OF THE INVENTION

Generally, a catalytic conversion of a hydrocarbon-containing reactant stream in a reaction system has at least two reaction zones where the reactant stream flows serially through the reaction zones. Reaction systems having multiple zones generally take one of two forms: a side-by-side form or a stacked form. In the side-by-side form, multiple and separate reaction vessels, each that can include a reaction zone, may be placed along side each other. In the stacked form, one common reaction vessel can contain multiple and separate reaction zones that may be placed on top of each other. In both reaction systems, there can be intermediate heating or cooling between the reaction zones, depending on whether the reactions can be endothermic or exothermic.

Although the reaction zones can include any number of arrangements for hydrocarbon flow such as downflow, upflow, and crossflow, the most common reaction zone to which this invention is applied may be radial flow. A radial flow reaction zone generally includes cylindrical sections having varying nominal cross-sectional areas, vertically and coaxially disposed to form the reaction zone. Briefly, a radial flow reaction zone typically includes a cylindrical reaction vessel containing a cylindrical outer catalyst retaining screen and a cylindrical inner catalyst retaining screen that are both coaxially-disposed within the reaction vessel. The inner screen may have a nominal, internal cross-sectional area that is less than that of the outer screen, which can have a nominal, internal cross-sectional area that is less than that of the reaction vessel. Generally, the reactant stream is introduced into the annular space between the inside wall of the reaction vessel and the outside surface of the outer screen. The reactant stream can pass through the outer screen, flow radially through the annular space between the outer screen and the inner screen, and pass through the inner screen. The stream that may be collected within the cylindrical space inside the inner screen can be withdrawn from the reaction vessel. Although the reaction vessel, the outer screen, and the inner screen may be cylindrical, they may also take any suitable shape, such as triangular, square, oblong, or diamond, depending on many design, fabrication, and technical considerations. As an example, generally it is common for the outer screen to not be a continuous cylindrical screen but to instead be an arrangement of separate, elliptical, tubular screens called scallops that may be arrayed around the circumference of the inside wall of the reaction vessel. The inner screen is commonly a perforated center pipe that may be covered around its outer circumference with a screen.

Preferably, the catalytic conversion processes include catalyst that can include particles that are movable through the reaction zones. The catalyst particles may be movable through the reaction zone by any number of motive devices, including conveyors or transport fluid, but most commonly the catalyst particles are movable through the reaction zone by gravity. Typically, in a radial flow reaction zone, the catalyst particles can fill the annular space between the inner and outer screens, which may be called the catalyst bed. Catalyst particles can be withdrawn from a bottom portion of a reaction zone, and catalyst particles may be introduced into a top portion of the reaction zone. The catalyst particles withdrawn from the final reaction zone can subsequently be recovered from the process, regenerated in a regeneration zone of the process, or transferred to another reaction zone. Likewise, the catalyst particles added to a reaction zone can be catalyst that is being newly added to the process, catalyst that has been regenerated in a regeneration zone within the process, or catalyst that is transferred from another reaction zone.

Illustrative reaction vessels that have stacked reaction zones are disclosed in U.S. Pat. No. 3,706,536 (Greenwood et al.) and U.S. Pat. No. 5,130,106 (Koves et al.), the teachings of which are incorporated herein by reference in their entirety. Generally, the transfer of the gravity-flowing catalyst particles from one reaction zone to another, the introduction of fresh catalyst particles, and the withdrawal of spent catalyst particles are effected through catalyst transfer conduits.

The feedstocks converted by these processes can include various fractions from a range of crude oils. One exemplary feedstock converted by these processes generally includes a stream, which may be a naphtha, including, in percent or parts by weight based on the total weight of hydrocarbons in the stream as disclosed in Table 1:

TABLE 1

| | Amounts | | |
|---|---|---|---|
| Component | General | Preferred | Optimal |
| $C_4$ or less: | less than about 0.5% | about 0% | about 0% |
| $C_5$ | no more than about 4% | about 0% | about 0% |
| $C_6$ | no more than about 30% | about 5–about 15% | about 5–about 15% |
| $C_7$ | about 10–about 50% | about 10–about 25% | about 10–about 25% |
| $C_8$ | about 20–about 50% | about 20–about 50% | about 20–about 50% |
| $C_9$ | no more than about 25% | about 10–about 25% | about 10–about 25% |
| $C_{10}$ | no more than about 15% | about 5–about 15% | about 5–about 15% |
| $C_{11}$ or greater | no more than about 2% | about 1–about 2% | about 1–about 2% |
| sulfur or sulfur containing compounds | less than about 1 ppm | less than about 0.5 ppm | less than about 0.2 ppm |
| nitrogen or nitrogen containing compounds | less than about 1 ppm | less than about 0.5 ppm | less than about 0.2 ppm |

The sulfur or sulfur containing compounds and the nitrogen or nitrogen containing compounds are measured as, respectively, elemental sulfur or nitrogen. The amounts of sulfur and nitrogen can be measured by, respectively, standard test methods D-4045-04 and D-4629-02 available from ASTM International, 100 Barr Harbor Drive, P.O. Box C700, West Conshohocken, Pa., U.S.A.

Processes having multiple reaction zones may include a wide variety of hydrocarbon conversion processes such as reforming, hydrogenation, hydrotreating, dehydrogenation, isomerization, dehydroisomerization, dehydrocyclization, cracking, and hydrocracking processes. Catalytic reforming also often utilizes multiple reaction zones, and will be referenced hereinafter in the embodiments depicted in the drawings. Further information on reforming processes may be found in, for example, U.S. Pat. No. 4,119,526 (Peters et al.); U.S. Pat. No. 4,409,095 (Peters); and U.S. Pat. No. 4,440,626 (Winter et al.).

Usually, in catalytic reforming, a feedstock is admixed with a recycle stream comprising hydrogen to form what is commonly referred to as a combined feed stream, and the combined feed stream is contacted with a catalyst in a reaction zone. The usual feedstock for catalytic reforming is a petroleum fraction known as naphtha and having an initial boiling point of about 82° C. (about 180° F.), and an end boiling point of about 203° C. (about 400° F.). The catalytic reforming process is particularly applicable to the treatment of straight run naphthas comprised of relatively large concentrations of naphthenic and substantially straight chain paraffinic hydrocarbons, which are subject to aromatization through dehydrogenation and/or cyclization reactions. The preferred charge stocks are naphthas consisting principally of naphthenes and paraffins that can boil within the gasoline range, although, in many cases, aromatics also can be present. This preferred class includes straight-run gasolines, natural gasolines, synthetic gasolines, and the like. As an alternative embodiment, it is frequently advantageous to charge thermally or catalytically cracked gasolines or partially reformed naphthas. Mixtures of straight-run and cracked gasoline-range naphthas can also be used to advantage. The gasoline-range naphtha charge stock may be a full-boiling gasoline having an initial boiling point of about 40-about 82° C. (about 104-about 180° F.) and an end boiling point within the range of about 160-about 220° C. (about 320-about 428° F.), or may be a selected fraction thereof which generally can be a higher-boiling fraction commonly referred to as a heavy naphtha, for example, a naphtha boiling in the range of about 100-about 200° C. (about 212-about 392° F.). In some cases, it is also advantageous to charge pure hydrocarbons or mixtures of hydrocarbons that have been recovered from extraction units, for example, raffinates from aromatics extraction or straight-chain paraffins, which are to be converted to aromatics. In some other cases, the feedstock may also contain light hydrocarbons that have 1-5 carbon atoms, but since these light hydrocarbons cannot be readily reformed into aromatic hydrocarbons, these light hydrocarbons entering with the feedstock are generally minimized.

An exemplary flow through the train of heating and reaction zones is a 4-reaction zone catalytic reforming process, having first, second, third and fourth reaction zones, which can be described as follows.

A naphtha-containing feedstock can admix with a hydrogen-containing recycle gas to form a combined feed stream, which may pass through a combined feed heat exchanger. In the combined feed heat exchanger, the combined feed can be heated by exchanging heat with the effluent of the fourth reaction zone. However, the heating of the combined feed stream that occurs in the combined feed heat exchanger is generally insufficient to heat the combined feed stream to the desired inlet temperature of the first reaction zone.

Generally, hydrogen is supplied to provide an amount of about 1-about 20 moles of hydrogen per mole of hydrocarbon feedstock entering the reaction zones. Hydrogen is preferably supplied to provide an amount of less than about 3.5 moles of hydrogen per mole of hydrocarbon feedstock entering the reaction zones. If hydrogen is supplied, it may be supplied upstream of the combined feed exchanger, downstream of the combined feed exchanger, or both upstream and downstream of the combined feed exchanger. Alternatively, no hydrogen may be supplied before entering the reforming zones with the hydrocarbon feedstock. Even if hydrogen is not provided with the hydrocarbon feedstock to the first reaction zone, the naphthene reforming reactions that occur within the first reaction zone can yield hydrogen as a by-product. This by-product, or in-situ-produced, hydrogen leaves the first reaction zone in an admixture with the first reaction zone effluent and then can become available as hydrogen to the second reaction zone and other downstream reaction zones. This in situ hydrogen in the first reaction zone effluent usually amounts to about 0.5-about 2 moles of hydrogen per mole of hydrocarbon feedstock.

Usually, the combined feed stream, or the hydrocarbon feedstock if no hydrogen is provided with the hydrocarbon feedstock, enters a heat exchanger at a temperature of generally about 38-about 177° C. (about 100-about 350° F.), and more usually about 93-about 121° C. (about 200-about 250° F.). Because hydrogen is usually provided with the hydrocarbon feedstock, this heat exchanger may be referred to herein as the combined feed heat exchanger, even if no hydrogen is supplied with the hydrocarbon feedstock. Generally, the combined feed heat exchanger heats the combined feed stream by transferring heat from the effluent stream of the last reforming reaction zone to the combined feed stream. Preferably, the combined feed heat exchanger is an indirect, rather than a direct, heat exchanger, in order to prevent valuable reformate product in the last reaction zone's effluent from intermixing with the combined feed, and thereby being recycled to the reaction zones, where the reformate quality could be degraded.

Although the flow pattern of the combined feed stream and the last reaction zone effluent stream within the combined feed heat exchanger could be completely cocurrent, reversed, mixed, or cross flow, the flow pattern is preferably countercurrent. By a countercurrent flow pattern, it is meant that the combined feed stream, while at its coldest temperature, contacts one end (i.e., the cold end) of the heat exchange surface of the combined feed heat exchanger while the last reaction zone effluent stream contacts the cold end of the heat exchange surface at its coldest temperature as well. Thus, the last reaction zone effluent stream, while at its coldest temperature within the heat exchanger, exchanges heat with the combined feed stream that is also at its coldest temperature within the heat exchanger. At another end (i.e., the hot end) of the combined feed heat exchanger surface, the last reaction zone effluent stream and the combined feed stream, both at their hottest temperatures within the heat exchanger, contact the hot end of the heat exchange surface and thereby exchange heat. Between the cold and hot ends of the heat exchange surface, the last reaction zone effluent stream and the combined feed stream flow in generally opposite directions, so that, in general, at any point along the heat transfer surface, the hotter the temperature of the last reaction zone effluent stream, the hotter is the temperature of the combined feed stream with which the last reaction zone effluent stream exchanges heat. For further information on flow patterns in heat exchangers, see, for example, pages 10-24 to 10-31 of Perry's Chemical Engineers' Handbook, Sixth Edition, edited by Robert H. Perry et al., published by McGraw-Hill Book Company in New York, in 1984, and the references cited therein.

Generally, the combined feed heat exchanger operates with a hot end approach that is generally less than about 56° C. (about 100° F.), and preferably less than about 33° C. (about 60° F.), and more preferably less than about 28° C. (about 50° F.). As used herein, the term "hot end approach" is defined as follows: based on a heat exchanger that exchanges heat between a hotter last reaction zone effluent stream and a colder combined feed stream, where T1 is the inlet temperature of the last reaction zone effluent stream, T2 is the outlet temperature of the last reaction zone effluent stream, t1 is the inlet temperature of the combined feed stream, and t2 is the outlet temperature of the combined feed stream. Then, as used herein, for a countercurrent heat exchanger, the "hot end approach" is defined as the difference between T1 and t2. In general, the smaller the hot end approach, the greater is the degree to which the heat in the last reactor zone's effluent is exchanged to the combined feed stream.

Although shell-and-tube type heat exchangers may be used, another possibility is a plate type heat exchanger. Plate type exchangers are well known and commercially available in several different and distinct forms, such as spiral, plate and frame, brazed-plate fin, and plate fin-and-tube types. Plate type exchangers are described generally on pages 11-21 to 11-23 in Perry's Chemical Engineers' Handbook, Sixth Edition, edited by R. H. Perry et al., and published by McGraw Hill Book Company, in New York, in 1984.

In one embodiment, the combined feed stream can leave the combined feed heat exchanger at a temperature of about 399-about 516° C. (about 750-about 960° F.).

Consequently, after exiting the combined feed heat exchanger and prior to entering the first reactor, the combined feed stream often requires additional heating. This additional heating can occur in a heater, which is commonly referred to as a charge heater, which can heat the combined feed stream to the desired inlet temperature of the first reaction zone. Such a heater can be a gas-fired, an oil-fired, or a mixed gas-and-oil-fired heater, of a kind that is well known to persons of ordinary skill in the art of reforming. The heater may heat the first reaction zone effluent stream by radiant and/or convective heat transfer. Commercial fired heaters for reforming processes typically have individual radiant heat transfer sections for individual heaters, and a common convective heat transfer section that is heated by the flue gases from the radiant sections.

Desirably, the stream first enters the radiant section of the heater. The stream can enter and exit the top or lower portion of the radiant section through U-shaped or inverted U-shaped tubes, or enter the top portion where the temperature is lowest in the radiant section and exit at the bottom where the temperature is hottest in the radiant section, or conversely, enter at the bottom and exit at the top. Preferably, the stream enters and exits the top portion of the radiant section for this and any subsequent heaters.

Afterwards, the combined feed stream can enter the convection section of that same heater. The stream can enter and exit the top or lower portion of the convection section, or enter the top portion where the temperature is lowest in the convection section and exit at the bottom where the temperature is hottest in the convection section through U-shaped tubes that are usually orientated sideways, or conversely, enter at the bottom and exit at the top. Preferably, the stream enters the top portion and exits the bottom portion of the convection section for this and any subsequent heaters. It should be understood that one or more heaters described herein (e.g., a charge or an interheater) can have the stream enter the radiant section then the convection section, may have the stream enter the convection section and then the radiant section, or may have the stream enter only the radiant or convection section, depending, e.g., on the maximum tube wall temperature limitations.

Commercial fired heaters for reforming processes typically have individual radiant heat transfer sections for individual heaters and a common convective heat transfer section that may be heated by the flue gases from the radiant sections. The temperature of the combined feed stream leaving the charge heater, which may also be the inlet temperature of the first reaction zone, is generally about 482-about 560° C. (about 900-about 1,040° F.), preferably about 493-about 549° C. (about 920-about 1,020° F.).

Once the combined feed stream passes to the first reaction zone, the combined feed stream may undergo conversion reactions. In a common form, the reforming process can employ the catalyst particles in several reaction zones interconnected in a series flow arrangement. There may be any number of reaction zones, but usually the number of reaction zones is 3, 4 or 5. Because reforming reactions occur generally at an elevated temperature and are generally endothermic, each reaction zone usually has associated with it one or more heating zones, which heat the reactants to the desired reaction temperature.

This invention can be particularly applicable in a reforming reaction system having at least two catalytic reaction zones where at least a portion of the reactant stream and at least a portion of the catalyst particles flow serially through the reaction zones. These reforming reaction systems can be a side-by-side form or a stacked form, as discussed above.

Generally, the reforming reactions are normally effected in the presence of catalyst particles comprised of one or more Group VIII (IUPAC 8-10) noble metals (e.g., platinum, iridium, rhodium, and palladium) and a halogen combined with a porous carrier, such as a refractory inorganic oxide. U.S. Pat. No. 2,479,110 (Haensel), for example, teaches an alumina-platinum-halogen reforming catalyst. Although the catalyst may contain about 0.05-about 2.0 wt-% of Group VIII metal, a less expensive catalyst, such as a catalyst containing about 0.05-about 0.5 wt-% of Group VIII metal may be used. The preferred noble metal is platinum. In addition, the catalyst may contain indium and/or a lanthanide series metal such as cerium. The catalyst particles may also contain about 0.05-about 0.5 wt-% of one or more Group IVA (IUPAC 14) metals (e.g., tin, germanium, and lead), such as described in U.S. Pat. No. 4,929,333 (Moser et al.), U.S. Pat. No. 5,128,300 (Chao et al.), and the references cited therein. Generally, the halogen is normally chlorine and the alumina is commonly the carrier. Preferred alumina materials are gamma, eta, and theta alumina, with gamma and eta alumina generally being most preferred. One property related to the performance of the catalyst is the surface area of the carrier. Preferably, the carrier has a surface area of about 100-about 500 $m^2/g$. The activity of catalysts having a surface area of less than about 130 $m^2/g$ tend to be more detrimentally affected by catalyst coke than catalysts having a higher surface area. Generally, the particles are usually spheroidal and have a diameter of about 1.6 to about 3.1 mm (about $1/16^{th}$-about $1/8^{th}$ inch), although they may be as large as about 6.35 mm (about $1/4^{th}$ inch) or as small as about 1.06 mm (about $1/24^{th}$ inch). In a particular reforming reaction zone, however, it is desirable to use catalyst particles which fall in a relatively narrow size range. A preferred catalyst particle diameter is about 1.6 mm (about $1/16^{th}$ inch).

A reforming process can employ a fixed catalyst bed, or a moving bed reaction vessel and a moving bed regeneration vessel. In the latter, generally regenerated catalyst particles are fed to the reaction vessel, which typically includes several reaction zones, and the particles flow through the reaction vessel by gravity. Catalyst may be withdrawn from the bottom of the reaction vessel and transported to the regeneration vessel. In the regeneration vessel, a multi-step regeneration process is typically used to regenerate the catalyst to restore its full ability to promote reforming reactions. U.S. Pat. No. 3,652,231 (Greenwood et al.), U.S. Pat. No. 3,647,680 (Greenwood et al.) and U.S. Pat. No. 3,692,496 (Greenwood et al.) describe catalyst regeneration vessels that are suitable for use in a reforming process. Catalyst can flow by gravity through the various regeneration steps and then be withdrawn from the regeneration vessel and transported to the reaction vessel. Generally, arrangements are provided for adding fresh catalyst as make-up to and for withdrawing spent catalyst from the process. Movement of catalyst through the reaction and regeneration vessels is often referred to as continuous though, in practice, it is semicontinuous. By semicontinuous movement it is meant as the repeated transfer of relatively small amounts of catalyst at closely spaced points in time. For example, one batch every twenty minutes may be withdrawn from the bottom of the reaction vessel and withdrawal may take five minutes, that is, catalyst can flow for five minutes. If the catalyst inventory in a vessel is relatively large in comparison with this batch size, the catalyst bed in the vessel may be considered to be continuously moving. A moving bed system can have the advantage of maintaining production while the catalyst is removed or replaced.

Typically, the rate of catalyst movement through the catalyst beds may range from as little as about 45.5 kg (about 100 pounds) per hour to about 2,722 kg (about 6,000 pounds) per hour, or more.

The reaction zones of the present invention can be operated at reforming conditions, which include a range of pressures generally from atmospheric pressure of about 0-about 6,895 kpa(g) (about 0 psi(g)-about 1,000 psi(g)), with particularly good results obtained at the relatively low pressure range of about 276-about 1,379 kpa(g) (about 40-about 200 psi(g)). The overall liquid hourly space velocity (LHSV) based on the total catalyst volume in all of the reaction zones is generally about 0.1-about 10 $hr^{-1}$, preferably about 1-about 5 $hr^{-1}$, and more preferably about 1.5-about 2.0 $hr^{-1}$.

As mentioned previously, generally naphthene reforming reactions that are endothermic occur in the first reaction zone, and thus the outlet temperature of the first reaction zone can be less than the inlet temperature of the first reaction zone and is generally about 316-about 454° C. (about 600-about 850° F.). The first reaction zone may contain generally about 5%-about 50%, and more usually about 10%-about 30%, of the total catalyst volume in all of the reaction zones. Consequently, the liquid hourly space velocity (LHSV) in the first reaction zone, based on the catalyst volume in the first reaction zone, can be generally 0.2-200 $hr^{-1}$, preferably about 2-about 100 $hr^{-1}$, and more preferably about 5-about 20 $hr^{-1}$. Generally, the catalyst particles are withdrawn from the first reaction zone and passed to the second reaction zone, such particles generally have a coke content of less than about 2 wt-% based on the weight of catalyst.

Because of the endothermic reforming reactions that occur in the first reaction zone, generally the temperature of the effluent of the first reaction zone falls not only to less than the temperature of the combined feed to the first reaction zone, but also to less than the desired inlet temperature of the second reaction zone. Therefore, the effluent of the first reaction zone can pass through another heater, which is commonly referred to as the first interheater, and which can heat the first reaction zone effluent to the desired inlet temperature of the second reaction zone.

Generally, a heater is referred to as an interheater when it is located between two reaction zones, such as the first and second reaction zones. The first reaction zone effluent stream leaves the interheater at a temperature of generally about 482-about 560° C. (about 900-about 1,040° F.). Accounting for heat losses, the interheater outlet temperature is generally not more than about 5° C. (about 10° F.), and preferably not more than about 1° C. (about 2° F.), more than the inlet temperature of the second reaction zone. Accordingly, the inlet temperature of the second reaction zone is generally about 482-about 560° C. (about 900-about 1,040° F.), preferably about 493-about 549° C. (about 920-about 1,020° F.). The inlet temperature of the second reaction zone is usually at least about 33° C. (about 60° F.) greater than the inlet temperature of the first reaction zone, and may be at least about 56° C. (about 100° F.) or even at least about 83° C. (about 150° F.) higher than the first reaction zone inlet temperature.

On exiting the first interheater, generally the first reaction zone effluent enters the second reaction zone. As in the first reaction zone, the endothermic reactions can cause another decline in temperature across the second reaction zone. Generally, however, the temperature decline across the second reaction zone is less than the temperature decline across the first reaction zone, because the reactions that occur in the second reaction zone are generally less endothermic than the reactions that occur in the first reaction zone. Despite the somewhat lower temperature decline across the second reaction zone, the effluent of the second reaction zone is nevertheless still at a temperature that is less than the desired inlet temperature of the third reaction zone.

The second reaction zone generally includes about 10%-about 60%, and more usually about 15%-about 40%, of the total catalyst volume in all of the reaction zones. Consequently, the liquid hourly space velocity (LHSV) in the second reaction zone, based on the catalyst volume in the second reaction zone, is generally about 0.13-about 134 $hr^{-1}$, preferably about 1.3-about 67 $hr^{-1}$, and more preferably about 3.3-about 13.4 $hr^{-1}$.

The second reaction zone effluent can pass a second interheater (the first interheater being the previously described interheater between the first and the second reaction zones), and after heating, can pass to a third reaction zone. However, one or more additional heaters and/or reactors after the second reaction zone can be omitted; that is, the second reaction zone may be the last reaction zone in the train. The third reaction zone contains generally about 25%-about 75%, and more usually about 30%-about 50%, of the total catalyst volume in all of the reaction zones. Likewise, the third reaction zone effluent can pass to a third interheater and from there to a fourth reaction zone. The fourth reaction zone contains generally about 30%-about 80%, and more usually about 40%-about 50%, of the total catalyst volume in all of the reaction zones. The inlet temperatures of the third, fourth, and subsequent reaction zones are generally about 482-about 560° C. (about 900-about 1,040° F.), preferably about 493-about 549° C. (about 920-about 1,020° F.).

Because the reforming reactions that occur in the second and subsequent (i.e., third and fourth) reaction zones are generally less endothermic than those that occur in the first reaction zone, the temperature drop that occurs in the later reaction zones is generally less than that that occurs in the first reaction zone. Thus, the outlet temperature of the last reaction zone may be about 11° C. (about 20° F.) or less below the inlet temperature of the last reaction zone, and indeed may conceivably be higher than the inlet temperature of the last reaction zone.

The desired reformate octane of the $C_5$+fraction of the reformate is generally about 85-about 107 clear research octane number ($C_5$+RONC), and preferably about 98-about 102 $C_5$+RONC.

Moreover, any inlet temperature profiles can be utilized with the above-described reaction zones. The inlet temperature profiles can be flat or skewed, such as ascending, descending, hill-shaped, or valley-shaped. Desirably, the inlet temperature profile of the reaction zones is flat.

The last reaction zone effluent stream can be cooled in the combined feed heat exchanger by transferring heat to the combined feed stream. After leaving the combined feed heat exchanger, the cooled last reactor effluent passes to a product recovery section. Suitable product recovery sections are known to persons of ordinary skill in the art of reforming. Exemplary product recovery facilities generally include gas-liquid separators for separating hydrogen and $C_1$-$C_3$ hydrocarbon gases from the last reaction zone effluent stream, and fractionation columns for separating at least a portion of the $C_4$-$C_5$ light hydrocarbons from the remainder of the reformate. In addition, the reformate may be separated by distillation into a light reformate fraction and a heavy reformate fraction.

During the course of a reforming reaction with a moving catalyst bed, catalyst particles become deactivated as a result of mechanisms such as the deposition of coke on the particles; that is, after a period of time in use, the ability of catalyst particles to promote reforming reactions decreases to the point that the catalyst is no longer useful. The catalyst can be reconditioned, or regenerated, before it is reused in a reforming process.

The drawings illustrate an embodiment of the present invention as applied to a catalytic reforming process. The drawings are presented solely for purposes of illustration and are not intended to limit the scope of the invention as set forth in the claims. The drawings show only the equipment and lines necessary for an understanding of the invention and do not show equipment such as pumps, compressors, heat exchangers, and valves which are not necessary for an understanding of the invention and which are well known to persons of ordinary skill in the art of hydrocarbon processing.

DETAILED DESCRIPTION OF THE DRAWINGS

Referring to FIG. 1, a refinery 100 is schematically depicted. The refinery 100 can include a desulfurization unit 150 and a reforming unit 200. The desulfurization unit 150 may include an inlet 154, an outlet 158, and a desulfurization reactor 180.

The reforming unit 200 can include a heat exchanger 204, a reforming reactor 210 having an inlet 212, an outlet 214, and a plurality of reaction zones 216, a separator 290, and at least one heater or furnace 300. Generally, the heat exchanger 204 heats the feed to the plurality of reaction zones 216 receiving an effluent 286 from a reaction zone. Generally, the plurality of reaction zones 216 includes a first reaction or a reaction zone 230 having an inlet 232 and an outlet 234, a second reaction zone 240 having an inlet 242 and an outlet 244, and a third reaction zone 250 having an inlet 252 and an outlet 254, and a fourth reaction zone 260 having an inlet 262 and an outlet 264. The first reaction zone inlet 232 can also be the inlet 212 of the reforming reactor 210. Similarly, the fourth reaction zone outlet 264 can also be the outlet 214 of the reforming reactor 210. The at least one heater 300, such as a plurality of heaters 302, can include a first or charge heater 306, and a plurality of interheaters 328. The plurality of interheaters 328 can include a first interheater 330, a second interheater 350, and a third interheater 370. The charge heater 306 can include at least one burner, preferably a plurality of burners, 308, a radiant section 310, and a convection section or a separate convection section 318; the first interheater 330 can include at least one burner, preferably a plurality of burners, 332, a radiant section 334, and a convection section 342; the second interheater 350 can include at least one burner, preferably a plurality of burners, 352, a radiant section 354, and a convection section 362; and the third interheater 370 can include at least one burner, preferably a plurality of burners, 372, a radiant section 374, and a convection section 382.

Each radiant section 310, 334, 354 and 374 generally includes, respectively, at least one radiant tube 312, 336, 356 and 376; and each convection section 318, 342, 362 and 382 generally includes, respectively, at least one convection tube 320, 344, 364 and 384. Each radiant tube 312, 336, 356, and 376 can include, respectively, an inlet 314 and an outlet 316, an inlet 338 and an outlet 340, an inlet 358 and an outlet 360, and an inlet 378 and an outlet 380. Each convection tube 320, 344, 364, and 384 can include, respectively, an inlet 322 and an outlet 324, an inlet 346 and an outlet 348, an inlet 366 and an outlet 368, and an inlet 386 and an outlet 388. Moreover, although only one tube is discussed for each section 310, 318, 334, 342, 354, 362, 374 and 382 and the plurality of burners 308, 332, 352, and 372 for each respective heater 306, 330, 350, and 370 in the reforming unit 200, it should be understood that generally each section can include an inlet manifold, a series of parallel tubes, and an outlet manifold and each heater can include several burners.

Moreover, in this exemplary embodiment, the reforming reactor 210 can be a moving bed reactor, where fresh or regenerated catalyst particles can be introduced through a line 220 via an inlet nozzle 222 and spent catalyst can exit via an outlet nozzle 224 via a line 226.

During processing, a raw hydrocarbon feed 140 enters the desulfurization unit 150 via an inlet 154. Generally, the raw hydrocarbon feed 140 is preferably naphtha optionally containing hydrogen that has not yet been desulfurized. The raw hydrocarbon feed 140 usually has high levels of impurities, such as sulfur and nitrogen, as discussed above. The raw hydrocarbon feed 140 may enter the desulfurization reactor 180 to remove sulfur and/or nitrogen containing compounds, as well as other possible contaminants. Desirably, the amounts of sulfur and nitrogen are reduced to the levels as disclosed above in Table 1.

Afterwards, a stream, a hydrocarbon stream, or a desulfurized hydrocarbon stream 270 may exit the desulfurization unit 150 and enter the reforming unit 200. Initially, the stream 270 may receive a recycled hydrogen gas stream 292 from the separator 290. Next, the stream 270 can enter the heat exchanger 204 to be heated by an effluent 286. That being done, generally the stream 270 enters the radiant section 310 via the inlet 314 to be heated in the at least one tube 312 by the plurality of burners 308 of the charge heater 306, and then can enter the convection section 318 via the inlet 322 to be heated in the at least one tube 320 by the flue gases. At this point, the stream 270 is sufficiently heated to be a feed 272 to the first reaction zone 230. The feed 272 may enter the first reaction zone 230 via the inlet 232 and exit via the outlet 234. An effluent 274 from the first reaction zone 230 can enter the radiant section 334 via the inlet 338 to be heated by the plurality of burners 332 of the first interheater 330, and then enter the convection section 342 to be heated by the flue gases. Afterwards, the stream 270 can be a feed 276 to the second reaction zone 240. The feed 276 may enter the second reaction zone 240 via the inlet 242 and exit via the outlet 244.

Subsequently, the stream 270 can be an effluent 278 from the second reaction zone 240 and enter via the inlet 358 of the radiant section 354 to be heated in the at least one tube 356 by the plurality of burners 352 of the second interheater 350. After exiting the radiant section 354 via the outlet 360, the stream 270 may enter the convection section 362 via the inlet 366 to be heated in the at least one tube 364 by the flue gases before entering the third reaction zone 250 via the inlet 252 as a feed 280 to the third reaction zone 250. Afterwards, the stream 270 can exit via the outlet 254 as the effluent 282 from the third reaction zone 250 that may enter the radiant section 374 of the third interheater 370 via the inlet 378 to be heated in the at least one tube 376 by the plurality of burners 372. That being done, the stream 270 can enter the convection section 382 via the inlet 386 to be heated by flue gases. Next, the stream 270 can enter via the inlet 262 as a feed 284 of the fourth reaction zone 260. After undergoing additional conversion, the stream 270 can exit as an effluent 286 of the fourth reaction zone 260 via the outlet 264. That being done, the effluent 286 can pass through the exchanger 204 to heat the stream 270, as discussed above.

Afterwards, the effluent 286 can enter the separator 290, where the recycled hydrogen gas stream can exit at the top of the separator 290 and a reformate stream 294 can exit at the bottom.

Although in this exemplary embodiment the stream 270 flows through the radiant section and then through the convection section in all of the heaters 306, 330, 350, and 370, it should be understood that one, two or three heaters in the series can have this flow sequence, and the remaining heaters can have a different arrangement, such as an opposite sequence, i.e., the stream 270 can flow through the convection section then the radiant section, or the stream 270 can flow only through a radiant section and not a convection section, or vice-versa.

Figure 2:
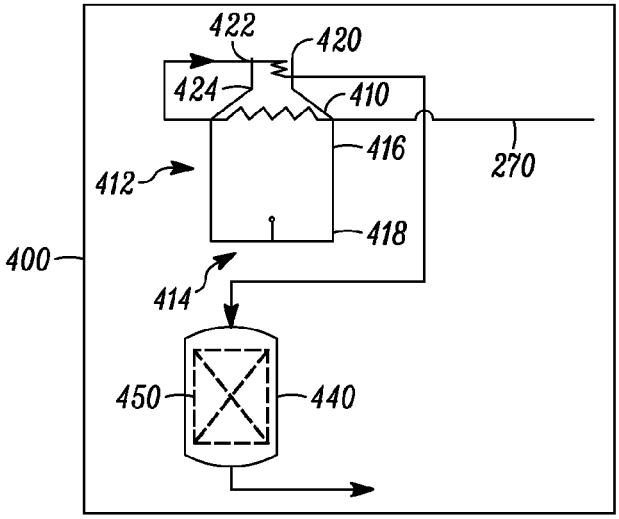
FIG. 2 is a schematic depiction of at least a portion of an exemplary reforming unit of the present invention.

In another exemplary embodiment as depicted in FIG. 2, at least a portion of a reforming unit 400 may include at least one heater or furnace 410 and at least one reforming reactor 440 including a reaction zone 450. Although only one furnace 410 and one reforming reactor 440 are depicted, it should be understood that the reforming unit 400 may include other furnaces or reforming reactors, such as side-by-side reforming reactors. As depicted, a stream 270 may enter the furnace 410 to be heated in a radiant section 412 having an upper portion 416 and a lower portion 418 by at least one burner, preferably a plurality of burners, 414 before entering a convection section 420. Generally, the stream 270, discussed above, enters and exits from the upper portion 416 of the radiant section 412 before entering the convection section 420. Desirably, the stream 270 enters a cooler, upper portion 422 of the convection section 420 and exits a hotter, lower portion 424. Afterwards, the stream 270 can enter the reforming reactor 440.

Although the embodiments discussed above can be designed for a new reforming unit, it should be understood that the disclosed features can implemented during the revamp of an existing heater to overcome, for example, limitations imposed by maximum tube wall temperatures. The maximum tube wall temperature for a heater can depend upon, for example, the composition or alloy of the tube. Generally, it is desired for the maximum tube wall temperature not to exceed about 640° C. (about 1,184° F.). For revamping such a heater in the reforming unit, it is estimated, although not wanting to be bound, that the unit could have an increased feed rate of about 10%-about 30%, possibly 20%.

Figure 3:
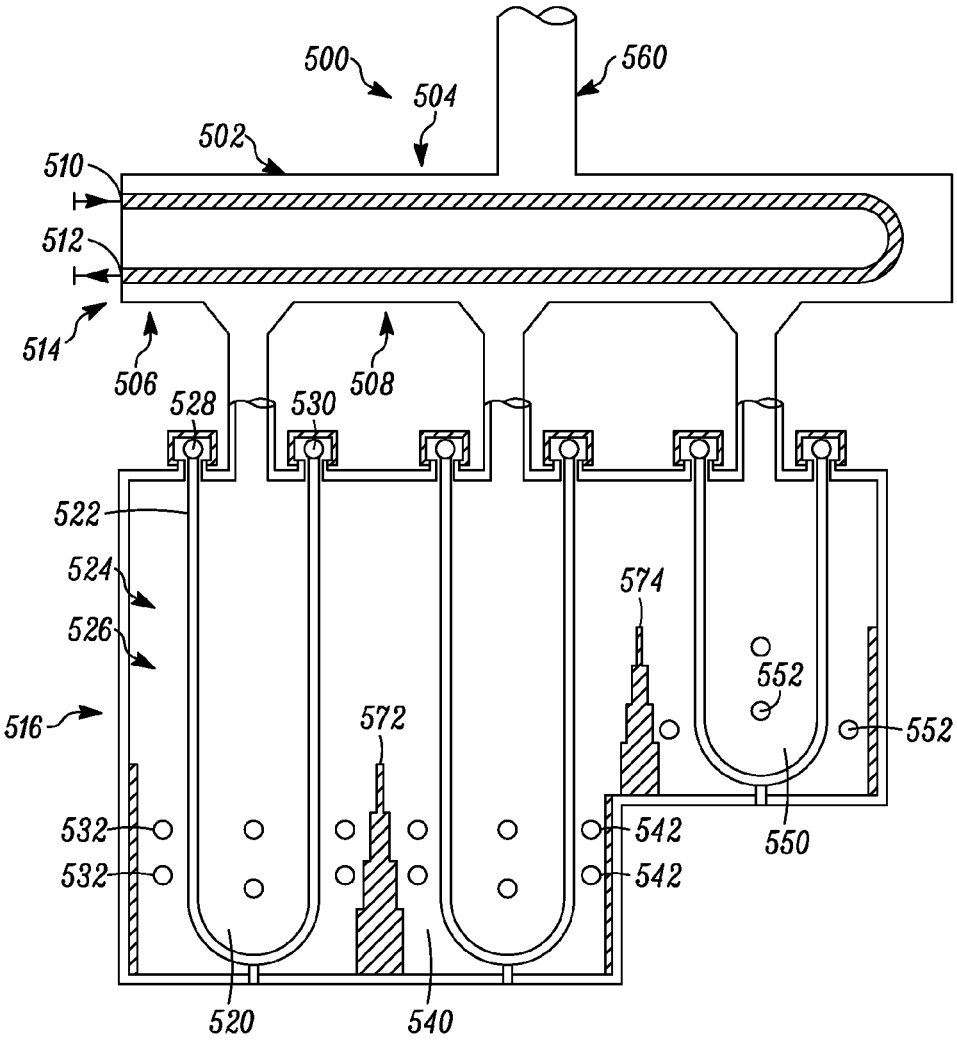
FIG. 3 is a schematic dual cross-sectional view of an exemplary heater with a common convection section and a plurality of radiant sections of the present invention.

Although the embodiments described above depict heaters with their own convection section, it should be understood that the reforming units described above may include one or more heaters or furnaces that have a plurality of radiant sections sharing a common convection section. Particularly, referring to FIG. 3, a heater 500 can include a common convection section 502 and a plurality of radiant sections 516, such as a first radiant or charge section 520, a second radiant or first interheater section 540, and a third radiant or second interheater section 550. The flue gas rising from the radiant sections 520, 540 and 550 can enter the convection section 502 and exit a stack 560. The common convection section 502 generally includes several convection tubes 506 in a parallel configuration 508. Each tube 506 having an inlet 510 and an outlet 512 can be somewhat U-shaped and orientated on its side, where several tubes 506 can be stacked front-to-back in rows. In this exemplary embodiment, the common convection section 502 can be divided into portions or rows 514. One or more convection tubes 506 can correspond to the first radiant section 520, namely the stream 270 can flow from the radiant section 520 to the row or portion 514 in the common convection section 502. Although convection tubes 506 can be orientated sideways, it should be understood that other orientations are possible, such as orientating the U-shaped tubes flat and stacking several tubes 506 vertically in rows.

Although only indicated in the first radiant section 520, generally each radiant section 520, 540 and 550 can include several radiant tubes 524 in a parallel configuration 526, desirably each radiant tube 522 having an inlet 528 and an outlet 530 may be somewhat U-shaped and orientated upwardly, and several such tubes 522 can be stacked front-to-back. The radiant sections 520, 540, and 550 can be separated by firewalls 572 and 574 and include, respectively, a plurality of burners 532, 542, and 552. Utilizing the heater 500, a hydrocarbon stream can enter, e.g., the first radiant section 520, then at least a portion of a convection section 502 before entering, e.g., a reforming reaction zone 230, as depicted in FIG. 1.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

Illustrative Embodiments

The following examples are intended to further illustrate the subject process. These illustrations of embodiments of the invention are not meant to limit the claims of this invention to the particular details of these examples. These examples are based on engineering calculations and actual operating experience with similar processes.

In these prophetic examples, different options for fired heater designs are analyzed for revamping a reforming unit. A first set of Example 1 discusses a revamp of one heater and a second set of Examples 2-5 discusses the revamp of another heater. For each set, unless otherwise indicated, the heater duties are for 4-reactor/4-heater processes, which are moving bed processes with continuous regeneration that within each set reform the same feedstock composition at the same feed rate and the LHSV, hydrogen to hydrocarbon molar ratio, reactor pressure, catalyst, $C_{5+}$RONC, catalyst distribution, and catalyst circulation rate each are the same within each set.

EXAMPLES

Example 1

The existing first interheater (second heater in a series of heaters) of the reforming unit has a maximum tube wall temperature limitation that prevents an increase in feed rate. In this example, it is desirable that the tube wall temperature be below about 635° C. (about 1,175° F.) Before revamping, the first interheater includes a process coil in the convection section followed, in the direction of flow of the first reaction zone effluent, by a process coil in the radiant section. An analysis of this fired heater cell shows that the calculated maximum tube wall temperature is 639° C. (1,183° F.). By reversing the order of the convection section and radiant sections, i.e. placing the radiant section first followed by the convection section, the maximum tube wall temperature drops to 606° C. (1,123° F.). Additionally, it can then be determined that the charge heater (the first heater in the series) has a maximum tube wall temperature of 638° C. (1,181° F.) for the revamp, and could also be modified by adding a process convection section coil in series and after with the existing radiant section. This new convection section coil is placed above the first interheater coil. The resultant charge heater maximum tube wall temperature drops from 638° C. (1,181° F.) to 619° C. (1,147° F.).

Examples 2-5

In this set, an existing heater is analyzed for revamping to meet increased duty requirements. The heater has five radiant cells sharing a common convection section. The common convection section has four rows of tubes, namely rows 1 and 2 in the lower portion of the convection section and rows 3 and 4 in the upper portion of the convection section. These radiant cells are a first charge cell (Cell A), a second charge cell (Cell A1), and three interheater cells (Cell B, Cell C and Cell D with Cell D being initially shutdown). These cells are used to heat the feed to respective reforming reaction zones. Moreover, in these examples it is generally desirable that the maximum tube wall temperature be below about 640° C. (about 1,184° F.).

Example 2

Initially, it is proposed to add a new radiant section as the first interheater (No. 1 IH), as disclosed in the following Table 2:

TABLE 2

| Service | Chg (first) | Chg (second) | No. 1 IH | No. 2 IH | No. 3 IH | Shutdown |
|---|---|---|---|---|---|---|
| Cell | A | A1 | New Furnace | B | C | D |
| Max tube wall existing coil, ° C. (° F.) | 612 (1,134) | 658 (1,216) | <635 (<1,175) | 700 (1,292) | 659 (1,218) | N/A |

It is generally more economical to use an existing interheater rather than construct a new one due to a longer turnaround time and a larger capital expense. However, even using a new radiant cell for the first interheater can result in the radiant section of Cells A1, B, and C exceeding the maximum tube wall temperature of 640° C. (1,184° F.). Emphasis added in the above and later tables.

Example 3

In this example, the existing heater is modified in an attempt to meet the increased duty requirements. As discussed above, modifying an existing heater is generally more economical than installing new radiant cells. In this example, Cell A is the radiant section of a charge heater, Cell A1 is the radiant section of the first interheater, Cells C and D are the radiant sections of a second interheater, and Cell B is the radiant section of the third interheater. Rows 3 and 4 and rows 1 and 2 of the convection section provide preheating to, respectively, Cell A and Cell A1. Cells B-D have no convective preheating. The existing heater coils are utilized. The results are depicted below in Table 3:

TABLE 3

| Service | Chg Htr. Convect. Rows 3 & 4 | Chg Htr Rad. Sect. | No 1 IH Convect. Rows 1 & 2 | No. 1 IH Rad. Sect. | No. 2 IH a | No. 2 IH b | No. 3 IH |
|---|---|---|---|---|---|---|---|
| | | | | | Series flow a to b | | |
| Cell | Upper Covect. | A | Lower Convect. | A1 | C | D | B |
| Max Tube Temp. ° C. (° F.) | 569 (1,056) | (701) 1,294 | 569 (1,056) | 639 (1,182) | 648 (1,198) | 648 (1,198) | 657 (1,215) |

The existing heater suffers several deficiencies, namely, the desired duty requirements could elevate maximum tube wall temperatures for Cells A, B, C and D to above 640° C. (1,184° F.), even with convection coil preheating the charge and first interheater radiant coils. Thus, the existing pass number, coil inside diameter (ID) and available radiant surface area are unacceptable for revamping to meet the desired duty requirements, even if the existing coils have good process hydraulics.

Example 4

In this example, the original coils of Cells A, A1 and B are changed to schedule 40 pipe, average wall. Moreover, the flow is split proportionally through Cells C and D of the second interheater. The results are depicted below in Table 4:

The average radiant flux values in Cell A approach the maximum revamp limit of 38,000 kcal/m$^2$*h (14,012 BTU/sq. ft.$^2$*hr) and in Cell A1 exceed the allowable flux limit, which is the first or No 1 interheater radiant section. The maximum tube wall temperature limit 640° C. (1,184° F.) is exceeded in cells A1, C, and D. No additional passes can be added to the radiant coils. Generally, although smaller ID coils have lower film temperatures and a resulting lower tube wall temperature, the smaller ID coils have less surface area per linear foot and less radiant surface area. Usually, larger ID coils have higher film temperatures and higher maximum tube wall temperatures. Achieving a balance between maximum radiant surface area and maximum tube wall temperature is typically desired. In this example, proportioning the flow in Cells C and D does not prevent exceeding the maximum tube wall temperature, while Cell B with a new, smaller coil inside diameter does not exceed the maximum tube wall temperature.

Example 5

In this example, the flow through rows 3 and 4 and rows 1 and 2 is reversed with respect to, respectively, Cells A and A1. In other words, the hydrocarbon flow first flows through Cells A and A1 before entering, respectively, rows 3 and 4 and rows

TABLE 4

| Service | Chg Htr Convect. Section Rows 3 & 4 | Chg Htr Radiant Section | No. 1 IH Convect. Section Rows 1 & 2 | No. 1 IH Radiant Section | No. 2 IH a | No. 2 IH b | No. 3 IH |
|---|---|---|---|---|---|---|---|
| | | | | | Proportional Flow Split | | |
| Cell | Upper Convect. | A | Lower Convect. | A1 | C | D | B |
| Pass No./ Pipe ID cm (inch) | 8/15 (6) | 54/5 (2) | 8/15 (6) | 54/5 (2) | 31/8 (3) (existing) | 20/8 (3) (existing) | 54/6.4 (2.5) |
| Avg. Radiant Flux, kcal/m$^2$ * hr. (BTU/ft.$^2$ * hr.) | | 37,043 (13,659) | | 41,644 (15,355) | 25,709 (9,479.7) | 25,709 (9,479.7) | 19,224 (7,095.8) |
| Max. Tube Temp., ° C. (° F.) | 504 (939) | 639 (1,182) | 490 (914) | 652 (1,206) | 718 (1,324) | 718 (1,324) | 626 (1,159) |
| Pressure Drop kg/ cm$^2$ (psi) | 0.18 (2.6) | 0.18 (2.6) | 0.25 (3.6) | 0.25 (3.6) | 0.050 (0.71) | 0.050 (0.71) | 0.15 (2.1) |

1 and 2. In addition, Cell D is recoiled to be a mirror image of Cell C and the flow through Cells C and D is put in series. The results are depicted below in Table 5:

TABLE 5

| Service | Chg Htr Radiant Section | Chg Htr Convect. Section Rows 3 & 4 | No. 1 IH Radiant Section | No. 1 IH Convect. Section Rows 1 & 2 | No. 2 IH a | No. 2 IH b | No. 3 IH |
|---|---|---|---|---|---|---|---|
| | | | | | Series Flow a to b | | |
| Cell | A | Upper Convect. | A1 | Lower Convect. | C | D | B |
| Pass No./ Pipe ID cm (inch) | 54/5 (2) | 8/15 (6) | 54/5 (2) | 8/15 (6) | 31/8 (3) (existing) | 31/8 (3) | 54/6.4 (2.5) |
| Avg. Radiant Flux, kcal/ $m^2$ * hr (BTU/ $ft.^2$ * hr.) | 37,299 (13,753) | | 44,084 (16,255) | | 21,147 (7,797.5) | 21,147 (7,797.5) | 19,224 (7,095.8) |
| Max. Tube Temp., ° C. (° F.) | 627 (1,161) | 561 (1,042) | 525 (977) | 570 (1,058) | 618 (1,144) | 653 (1,207) | 626 (1,159) |
| Pressure Drop kg/ $cm^2$ (psi) | 0.19 (2.7) | 0.17 (2.4) | 0.27 (3.8) | 0.40 (5.7) | 0.18 (2.6) | 0.18 (2.6) | 0.15 (2.1) |

Reversing the flow patterns between the radiant and convection sections result in the radiant sections of the charge heater and first interheater (Cells A and A1) not exceeding the maximum tube wall temperature, despite that additional surface area is required to lower the maximum average radiant flux in the first interheater radiant section (Cell A1). Also, section b of the second interheater (Cell D) exceeds the maximum tube wall temperature, so the series flow through parts a and b of the second interheater (Cells C and D) does not appear to remedy the maximum tube wall temperature limitation for this heater.

To remedy these shortcomings, other modifications can be made. As an example, the process duty load of a heater can be increased, the convection surface area in the reforming process service can be increased, and service may be added to the charge heater. In addition, smaller diameter coils can replace existing coils and the flow may be split to pass through two or more cells in a parallel configuration. Another modification can be adding coil surface area to at least one cell.

As depicted above, reversing the flow so that hydrocarbons pass first through the radiant section before entering the convection section can aid in the reduction of tube wall temperature to avoid maximum temperature limit constraints.

In the foregoing, all temperatures are set forth uncorrected in degrees Celsius and, all parts and percentages are by weight, unless otherwise indicated.

The entire disclosures of all applications, patents and publications cited herein are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A hydrocarbon conversion process, comprising:

a) passing a hydrocarbon stream comprising, in percent or parts by weight based on the total weight of hydrocarbons in the hydrocarbon stream:

$C_4$ or less: less than about 0.5%, sulfur or sulfur containing compounds: less than about 1 ppm, and nitrogen or nitrogen containing compounds: less than about 1 ppm, wherein the sulfur or sulfur containing compounds and the nitrogen or nitrogen containing compounds are measured as, respectively, elemental sulfur or nitrogen;

through at least one heater comprising at least one burner for producing heat, a radiant section having at least one radiant section tube, and a convection section having at least one convection section tube in fluid communication with the at least one radiant section tube, wherein, (i) without first passing through the at least one convection section tube and before exiting the at least one heater, the hydrocarbon stream passes through the at least one radiant section tube before the hydrocarbon stream enters and passes through the at least one convection section tube so that (ii) the temperature of the hydrocarbon stream entering the at least one convection section tube is substantially similar to the temperature of the hydrocarbon stream exiting the at least one radiant section tube, and (iii) the at least one convection section tube receives from about 10% to about 45% of the heat produced by the at least one burner.

2. The hydrocarbon conversion process according to claim 1, further comprising passing the hydrocarbon stream through a plurality of reaction zones; wherein the at least one heater comprises a charge heater comprising a plurality of burners, a charge heater radiant section, and a convection section wherein the hydrocarbon stream passes through the charge heater radiant section and then through the convection section before exiting the heater to enter a first reaction zone.

3. The hydrocarbon conversion process according to claim 2, wherein the at least one heater further comprises a plurality of interheaters, wherein each interheater comprises at least one burner and a radiant section, and forms a common convection section with at least one other interheater.

4. The hydrocarbon conversion process according to claim 3, further comprising passing an effluent stream from a first reaction zone to a first interheater wherein the effluent stream from the first reaction zone passes through the at least one radiant section tube of the first interheater and then through the at least one convection section tube of the first interheater before exiting the first interheater to enter a second reaction zone.

5. The hydrocarbon conversion process according to claim 1, further comprising passing the stream through a plurality of reaction zones; wherein the at least one heater comprises a plurality of interheaters, wherein each interheater comprises at least one burner, a radiant section, and a convection section or forms a common convection section with at least one other heater.

6. The hydrocarbon conversion process according to claim 5, further comprising passing an effluent stream from a first reaction zone to a first interheater wherein the effluent stream from the first reaction zone passes through the at least one radiant section tube of the first interheater and then through the at least one convection section tube of the first interheater before exiting the first interheater to enter a second reaction zone.

7. The hydrocarbon conversion process according to claim 1, wherein the hydrocarbon conversion process comprises reforming, alkylating, dealkylating, hydrogenating, hydrotreating, dehydrogenating, isomerizing, dehydroisomerizing, dehydrocyclizing, cracking, or hydrocracking.

8. The hydrocarbon conversion process according to claim 1, further comprising adding a recycled hydrogen gas stream comprising hydrogen to the stream comprising hydrocarbons.

9. The hydrocarbon conversion process according to claim 8, further comprising separating the recycled hydrogen gas stream from an effluent from a reaction zone.

10. A reforming process, comprising:

a) operating a reforming unit comprising:

i) at least one heater comprising at least one burner for producing heat, a radiant section having at least one radiant section tube, and a convection section having at least one convection section tube in fluid communication with the at least one radiant section tube, and ii) a reforming reactor comprising a reaction zone; and b) without first passing through the at least one convection section tube and before exiting the at least one heater, passing a process fluid stream comprising hydrocarbons through the at least one radiant section tube before the process fluid stream enters and passes through the at least one convection section tube, to an inlet of the reaction zone, wherein i) the temperature of the process fluid stream entering the at least one convection section tube is substantially similar to the temperature of the process fluid stream exiting the at least one radiant section tube, and ii) the at least one convection section tube receives from about 10% to about 45% of the heat produced by the at least one burner.

11. The reforming process according to claim 10, wherein operating the reforming unit, further comprises operating a plurality of heaters, wherein each heater comprises at least one burner, a radiant section, and at least a portion of a convection section; and wherein the reforming reactor comprises a first, a second, a third, and a fourth reaction zone.

12. The reforming process according to claim 11, wherein operating the plurality of heaters, comprising operating a charge heater before the first reaction zone and an interheater before each of the second, third and fourth reaction zones.

13. The reforming process according to claim 12, wherein passing the process fluid stream comprises at least one of:

passing a feed stream through the at least one radiant section tube of the charge heater and next through the at least one convection section tube of the charge heater to the first reaction zone;

passing a first effluent stream from the first reaction zone through the at least one radiant section tube of a first interheater and next through the at least one convection section tube of the first interheater to the second reaction zone;

passing a second effluent stream from the second reaction zone through the at least one radiant section tube of a second interheater and next through the at least one convection section tube of the second interheater to the third reaction zone; and passing a third effluent stream from the third reaction zone through the at least one radiant section tube of a third interheater and next through the at least one convection section tube of the third interheater to the fourth reaction zone.

14. The reforming process according to claim 10, further comprising adding a recycled gas stream comprising hydrogen to the process fluid stream comprising hydrocarbons.

15. The reforming process according to claim 14, further comprising separating the recycled hydrogen gas stream from an effluent stream from the reaction zone.

16. The reforming process according to claim 11, wherein the plurality of heaters form a common convection section.

17. The reforming process according to claim 11, wherein each of the plurality of heaters has a separate convection section.

18. The reforming process according to claim 10, further comprising desulfurizing the process fluid stream comprising hydrocarbons before entering the reforming unit.

19. A facility consisting of at least one of a refinery and a petrochemical production facility, comprising:

a) a reforming unit comprising:

i) a heater comprising a burner for producing heat, a radiant section comprising a first tube, having an inlet and an outlet for receiving and discharging, respectively, a hydrocarbon stream entering the heater, and a convection section comprising a second tube in fluid communication with the first tube of the radiant section, the second tube having an inlet for receiving the hydrocarbon stream at a temperature substantially similar to the temperature of the hydrocarbon stream exiting the first tube of the radiant section, and an outlet for discharging the hydrocarbon stream, the second tube of the convection section receiving from about 10% to about 45% of the heat produced by the burner;

ii) wherein, without first passing through the second tube of the convection section and before exiting the heater, the hydrocarbon stream passes through the first tube of the radiant section tube before the hydrocarbon stream passes through the second tube of the convection section to an inlet of the reaction zone, iii) a reforming reactor comprising a reaction zone wherein the inlet of the reaction zone receives the hydrocarbon stream from the outlet of the second tube of the convection section.

20. The facility according to claim 19, further comprising:

a desulfurization unit comprising a desulfurization reactor; wherein an outlet of the desulfurization unit provides a desulfurized hydrocarbon stream to the reforming unit.

21. The hydrocarbon conversion process according to claim 1, wherein passing the hydrocarbon stream further comprising:

$C_8$: about 20-about 50% in percent by weight based on the total weight of hydrocarbons in the stream.

* * * * *